US005666836A

United States Patent [19]

Bonnefont et al.

[11] Patent Number: 5,666,836

[45] Date of Patent: Sep. 16, 1997

[54] PROCESS AND INSTALLATION FOR PLANISHING A THIN METAL STRIP

[75] Inventors: Marc Bonnefont, Saint-Chamond; Zalman Padwo; Jean-Baptiste Peyron, both of Saint-Etienne; Paul Sabatier, Cellileu, all of France

[73] Assignee: CLECIM, Cergy-Pontoise, France

[21] Appl. No.: 381,680

[22] Filed: Jan. 31, 1995

[30] Foreign Application Priority Data

Feb. 1, 1994 [FR] France ..... 94 01090

[51] Int. Cl.[6] ..... B21D 1/05

[52] U.S. Cl. ..... 72/7.2; 72/164; 72/205

[58] Field of Search ..... 72/164, 165, 7, 72/205, 7.1, 7.2

[56] References Cited

U.S. PATENT DOCUMENTS

| | | | |
|---|---|---|---|
| 3,326,026 | 6/1967 | Guillot | 72/164 |
| 3,327,509 | 6/1967 | Roesch | 72/164 |
| 4,881,392 | 11/1989 | Thompson | 72/164 |

FOREIGN PATENT DOCUMENTS

| | | | |
|---|---|---|---|
| 22 51 735 | 5/1973 | Germany . | |
| 23 30 064 | 11/1974 | Germany . | |
| 30563 | 6/1982 | Japan | 72/205 |
| 179320 | 7/1990 | Japan | 72/205 |
| 294018 | 12/1991 | Japan | 72/164 |

OTHER PUBLICATIONS

Patent Abstracts of Japan JP4138821.
Patent Abstracts of Japan JP1317620.
Patent Abstracts of Japan JP58116931.

*Primary Examiner*—Daniel C. Crane
*Attorney, Agent, or Firm*—Pollock, Vande Sande & Priddy

[57] ABSTRACT

A process for planishing under traction a thin metal strip in an installation including a planisher comprising at least one bending unit with two planishing sets and a multi-roller leveling assembly comprising two rows of rollers. The imbrication of the planishing sets and the multi-roller leveling assembly and two tension blocks, respectively, are adjusted upside and downside to obtain a prescribed elongation of the strip. Flatness faults in the planisher are corrected by adjusting the through-speeds and imbrication of the planishing sets, such that the prescribed elongation for planishing is substantially attained by the time the strip leaves the planisher. At least longitudinal camber faults due to the passage in the planisher are corrected in the multi-roller assembly by setting up degressive imbrications of the rollers between the input and output of the multi-roller assembly by swinging one row with respect to the other so as to cause progressively diminishing reverse bending effects without substantially increasing the elongation already produced in the planisher by traction-bending.

13 Claims, 3 Drawing Sheets

PROCESS AND INSTALLATION FOR PLANISHING A THIN METAL STRIP

BACKGROUND OF THE INVENTION

1. Field of the Invention

The object of the invention is a process and installation for planishing under tension a thin metal strip.

2. Background Information

Hard, thin, sheet steel such as tinned sheet iron, used notably in the manufacture of packaging, is produced by rolling in the form of long lengths of thin metal strip which is subsequently treated, split and shaped according to the intended use.

In general, a thin metal strip must exhibit a certain number of qualities such as excellent flatness and an aptitude for stamping, and surface state and mechanical properties complying with the standard specifications corresponding to the desired applications.

To obtain these qualities, the metal strip undergoes a certain number of processing stages and is, in particular, subjected to planishing which is often performed by stretcher-and-roller leveling with prescribed elongation.

A planishing machine generally comprises one or two bending units each made up of a pair of small-diameter rolls placed on both sides of the strip and which are offset in height so as to set up, by their imbrication, an elbowed path for the strip producing reverse bendings on the two rolls.

The strip is brought under tension between the two tension blocks placed in position on both sides of the machine, each one comprising several imbricated rolls on which the strip travels. The rolls making up the two tension blocks are driven in rotation at slightly different speeds such that the through-speed of the strip in the downside tension block is fractionally higher than its through-speed in the upside block.

This results in permanent elongation of the strip, the value of which can be determined by adjusting the difference between the upside and downside through-speeds.

Planishing is performed by subjecting the strip while under tension to at least two reverse bendings on small-diameter rolls. It is known that, at the time of each bending, the external stretched part of the strip can be in the domain of plastic deformation, even if the tensile stress applied is well below the elastic limit. It is therefore possible, without subjecting the strip to excessive stress, to induce, between the two tension blocks, sufficient elongation to exceed the length of the longest fiber so as to planish the strip by equalizing the lengths of all its longitudinal fibers.

The smaller the radii of curvature and the greater the tensile stresses, the more substantial the permanent elongation values for a given product become, the tensile stresses nevertheless always remain below the elastic limit.

It is thus possible to obtain smooth strips, but these operations induce internal stresses within the thickness of the strip. These balance out, but nevertheless result in the deformation of the strip's profile, which generally presents a camber in the transversal direction, and quite often, a camber in the longitudinal direction too.

Transversal camber can be relatively easily corrected on a transversal camber correction device placed in position on the downside of the planisher. This device comprises a roll that bears against the strip on the side opposite that on which the last roll of the planisher bears and is associated with two larger-diameter rollers.

The longitudinal camber fault can be corrected on a longitudinal camber correction roll although in the case of very thin, hard strip, this correction is difficult to perform, particularly due to the very high sensitivity of the devices used. Indeed, for very thin strip, faults are very transitory and fluctuating for a given machine adjustment.

Yet residual longitudinal camber can impede the introduction of the strip into the succeeding processing installations and can, in addition, result in deformations when the strip is cut into narrow bands according to the dimensions of the products to be produced.

While it is possible to manually adjust the machine's settings, the high winding speed of the strip only allows correction of detectable faults and, unavoidably, only after a certain delay. Furthermore, the settings might have to be readjusted again when the next coil begins feeding.

SUMMARY OF THE INVENTION

The object of the invention is a process which makes it possible to correct, in a satisfactory way, faults induced by planishing, and in particular longitudinal camber faults. The process of the invention provides excellent operating flexibility, and after a first choice has been made, the process is able to immediately adapt the settings to the properties of the strip, even, if necessary, during feeding.

In a general way, the object of the invention is to produce products exhibiting small, relatively homogenous, longitudinal cambers, and maintain them when necessary in the same direction if a more satisfactory result cannot be obtained.

The process of the invention relates to an installation comprising a stretcher-and-roller leveling planisher comprising at least one bending unit made up of a pair of rolls offset in height and a multi-roller leveling assembly comprising two chassis, respectively lower and upper, each supporting a row of parallel rollers, offset longitudinally and in height, in such a way as to set up, by imbrication in the rollers, an undulating feed path of the strip with reverse bendings, means for adjusting the imbrication of the rolls of each bending unit, means for adjusting the imbrication of the rollers of the leveling assembly and two tension blocks placed in position, respectively, on the upside and downside of the installation on the feed path of the strip to apply tensile stress which is able to determine an elongation of the strip, the value of said elongation being imposed by adjusting the through-speeds in said blocks.

In accordance with the invention, flatness faults are corrected in the planisher by adjusting the through-speeds and the imbrication of the planishing sets such that most of the elongation prescribed for planishing has been achieved by the time the strip leaves the planisher. The multi-roller assembly then corrects at least the longitudinal cambering faults due to the passage in the planisher by creating degressive imbrications of the rollers between the input and output of the multi-roller assembly by swinging one row with respect to the other so as to cause progressively smaller reverse bending effects which relax the stresses. The numbers and intensities of the reverse bendings are determined by adjusting imbrications respectively at the input and output of the multi-roller assembly so as to correct the camber fault without substantially increasing the elongation already achieved in the planisher by traction and rolling.

The transversal camber correction can be performed at the same time as the longitudinal camber correction in the multi-roller assembly. Alternatively, an anti-longitudinal camber device can be placed between the planisher and multi-roller assembly to correct longitudinal camber at least partially before the strip enters the multi-roller assembly.

According to another particularly advantageous embodiment of the invention, the adjustments made to the imbrications in the bending units of the planisher take account of the dimensional and structural characteristics of the strip in order to produce, in the planisher, the elongation prescribed for the flatness correction. The tensile stress applied to the strip is generally maintained below approximately 60% of the metal's elastic limit, and the imbrications are adjusted, respectively, at the input and output of the multi-roller assembly, to correct the camber faults while limiting the increase in traction in such a way that the supplemental elongation occurring in the multi-roller assembly does not normally exceed 0.2%.

According to another preferred embodiment, the imbrications of the planisher and multi-roller assembly are adjusted for each coil and/or are permanently determined during the winding of the strip by a process control system that takes account of all the dimensional, structural and qualitative characteristics of the product, the known diameters of the live rolls, the stresses applied to the strip and the interactions between the different devices of the installation.

In a particularly advantageous manner, the process control system is associated with a mathematical model which is loaded with all the specific characteristics of the product to process and of the installation before a coil is processed. This mathematical model generates the imbrication reference values for the different devices from programmed equations and takes into account indications obtained by measurement or observation of residual flatness faults and longitudinal and transverse camber faults during the processing of a strip of similar nature and dimensions.

According to a simpler embodiment, the process control system determines the imbrications of the different devices from tables drawn up for each type of product, taking account of the specific characteristics of the machine and indications obtained previously by measurement or observation of residual flatness faults and longitudinal and transverse camber faults during the processing of a strip of similar nature and dimensions.

According to another extremely advantageous embodiment, the operator can at any time manually correct each of the adjustments controlled by the process control system according to observations and measurements taken on the product during and/or after processing.

Preferably, the manual corrections thus made are recorded, classed and possibly optimized in a self-adapting system which stores them in memory, and, after unlocking by the operator, introduces the necessary modifications into the process control system so that from then onwards, the imbrication reference values thus corrected are imposed on the different devices during the feeding of the strip and for the succeeding strips of the same type.

Once the planishing process of a strip of known characteristics has been fine-tuned, the invention allows the same process to be automatically applied to strips having the same characteristics and, in particular, originating from the same source, the flatness faults resulting, among other things, from the stages of production of the strip from liquid steel up to its final form and thus generally repeated on strips from the same source.

Moreover, after checking by a competent authority, the corrections recorded in the self-adapting system can be validated and introduced into the mathematical model which is readjusted such that the generated reference values correspond to the previously corrected imbrications.

The invention also provides the means for very quickly obtaining the correct adjustments for coils of a product whose characteristics do not correspond to those of one of the coils already processed. In this case, the operator can select one or more reference types that correspond as closely as possible to the new coil and then enter on the process control system either the parameters corresponding to a type that closely resembles it, or interpolated or extrapolated parameters, so as to determine, according to the type or types of reference, the tension and imbrication reference values of the different devices for the new coil. The operator then starts up the winding of the coil and manually corrects the reference values determined by the process control system according to the effects obtained on the strip during winding.

The corrections thus made to the reference values given by the mathematical model are recorded in the self-adapting system which can be unlocked by the operator, if the corrections are deemed useful, so that the corrected reference values are used for the rest of the winding of the coil and for similar coils.

After approval and validation by a competent authority, the corrected reference values can be stored in the mathematical model to form a new model subsequently usable for all similar coils.

BRIEF DESCRIPTION OF THE DRAWINGS

The invention will be better understood from the following description of a particular embodiment, by way example and shown in the accompanying drawings.

DESCRIPTION OF THE PREFERRED EMBODIMENTS

Figure 1:
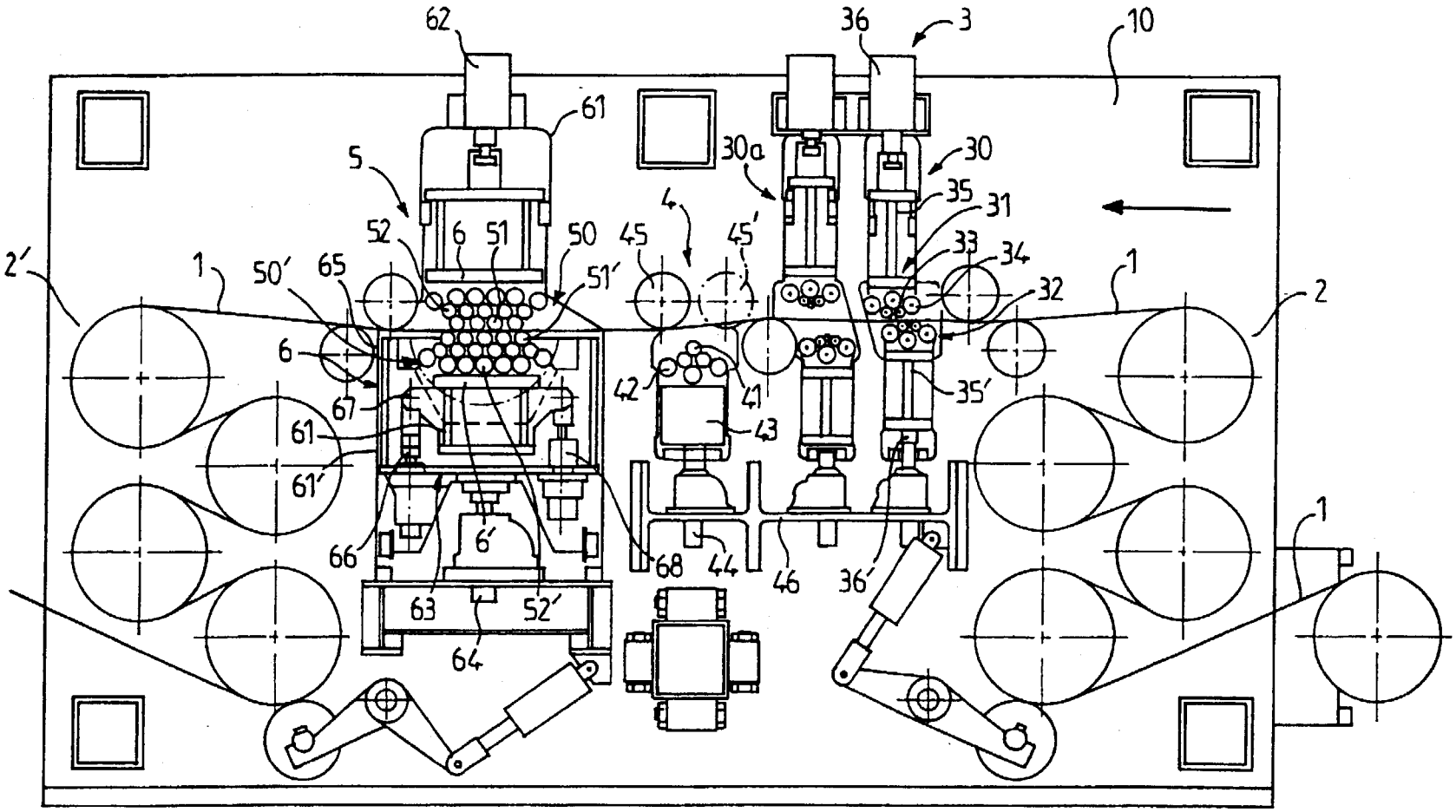
FIG. 1 is schematic longitudinal section view showing the overall planishing installation for carrying out the process of the invention.

FIG. 1 is a longitudinal section of the overall planishing installation for a metal strip 1 which, travels from right to left passing successively through an upside tension block 2, a planisher 3 comprising, in the example shown, two bending units 31, 32, an anti-transversal camber device 4, a multi-roller leveling assembly 5 and a downside tension block 2'.

All these elements are arranged in a frame 10 in the form of a cage associated with means (not shown) for maintaining and replacing the different devices.

The two tension blocks 2, 2' each comprise the usual several relatively large diameter rollers around which strip 1 winds to obtain the necessary traction, the rollers being driven in rotation by a mechanism (not shown) such that the winding speed is fractionally higher on the downside tension block 2' than on the upside tension block 2, the difference in speed being adjusted to determine the desired elongation.

Planisher 3 is of conventional type and, in particular, each bending unit 30 comprises two planishing sets 31, 32, placed in position, respectively, above and below the strip.

Each planishing set 31 (32) comprises a small-diameter live roll 33 (33') whose side furthest from the strip bears against supporting rolls 34 (34'), the assembly being placed in position on a chassis 35 (35') which can slide vertically with respect to cage 10 and whose vertical position can be adjusted by one or more hydraulic or mechanical actuators 36 (36').

In general, upper set 31 can move under the action of jacks 36 between an upper standby position away from the strip, and a lower working position in contact with the strip. Mechanical screw jacks 36 provide a means of varying the level of lower set 32 in order to adjust the imbrication of live rolls 33, 33'.

The second bending unit 30*a* can be adjusted in the same way. In addition, as shown in FIG. 1, the live rolls can be completely withdrawn from the strip allowing one or both bending units to be used, depending on the case.

The anti-transversal camber device 4 is of a conventional type and comprises a live roll 41 placed in position between two much larger diameter rollers 45, 45', live roll 41 also resting on a set of supporting rolls 42 supported by a sliding chassis 43 whose position can be adjusted by jack 44. This makes it possible to adjust the pressure applied to the strip by roll 41 of the anti-transversal camber device which nests between the two rollers 45, 45'.

Note that the anti-transversal camber device is not always indispensable and can be omitted in the simplest installations. It may nonetheless be preferable to provide for a position 46 on frame 10 of the installation for the anti-transversal camber device which, in this way, can be added to the machine should the need arise. Likewise, anti-transversal camber roll 41 can be simply withdrawn from the strip or removed from service depending on the qualities of the sheet metal.

Multi-roller assembly 5, which is placed in position on the downside of anti-transversal camber device 4 and before downside tension block 2', comprises two sets of rollers, namely an upper set 50 and a lower set 50' arranged respectively on either side of the feed path of strip 1.

Each assembly 50 (50) is supported by a chassis, respectively upper 6 and lower 6', and comprises a row of parallel rollers 51 whose sides furthest from strip 1 bear against one or two rows of pressure rollers 52.

The two sets of rollers 51, 51' are longitudinally offset and can therefore nest inside one another by adjusting the relative heights of chasses 6, 6' so as to define a zig-zag path. Generally, lower row 51' contains one more roller than upper row 51, although this arrangement depends on circumstances, particularly the nature of strip 1 and the distribution of stresses.

Chassis 6 supporting upper assembly 50 is mounted so for vertical sliding movement in two windows 61 of cage 10 and can be placed, by means of two jacks 62, either in the lower working position, or in the standby position away from the strip.

In a similar way, chassis 6' of lower assembly 50' is mounted on a frame in the form of a chest 63 which can slide vertically in windows 61' of cage 10 and whose position can be adjusted by a jack 64, thus allowing the vertical movement, parallel to itself, of the lower row of rollers 51'.

Lower chassis 6' forms a cradle which rests on two circular tracks 65 provided on frame 63 forming a circular rolling path centered on a horizontal axis parallel to the axes of rollers 51' and placed in position substantially at the level of the plane tangent to the roller axes.

Cradle 6' can thus swing with respect to frame 63 by turning about the axis of circular tracks 65 under the action of a screw jack 66 mounted on frame 55 and bearing, via an articulated rod system, on an arm 67 integral with chassis 6', which is held applied on circular tracks 65 by a jack 68 fixed on frame 63 and allowing play to be taken up.

Other swing systems could clearly be used for this purpose.

Screw jack 66 therefore provides a means of adjusting the inclination of lower roller row 51' with respect to upper row 51, while screw jacks 64 provide a means of globally increasing or reducing the spacing between the two roller rows 51, 51'.

Figure 3:
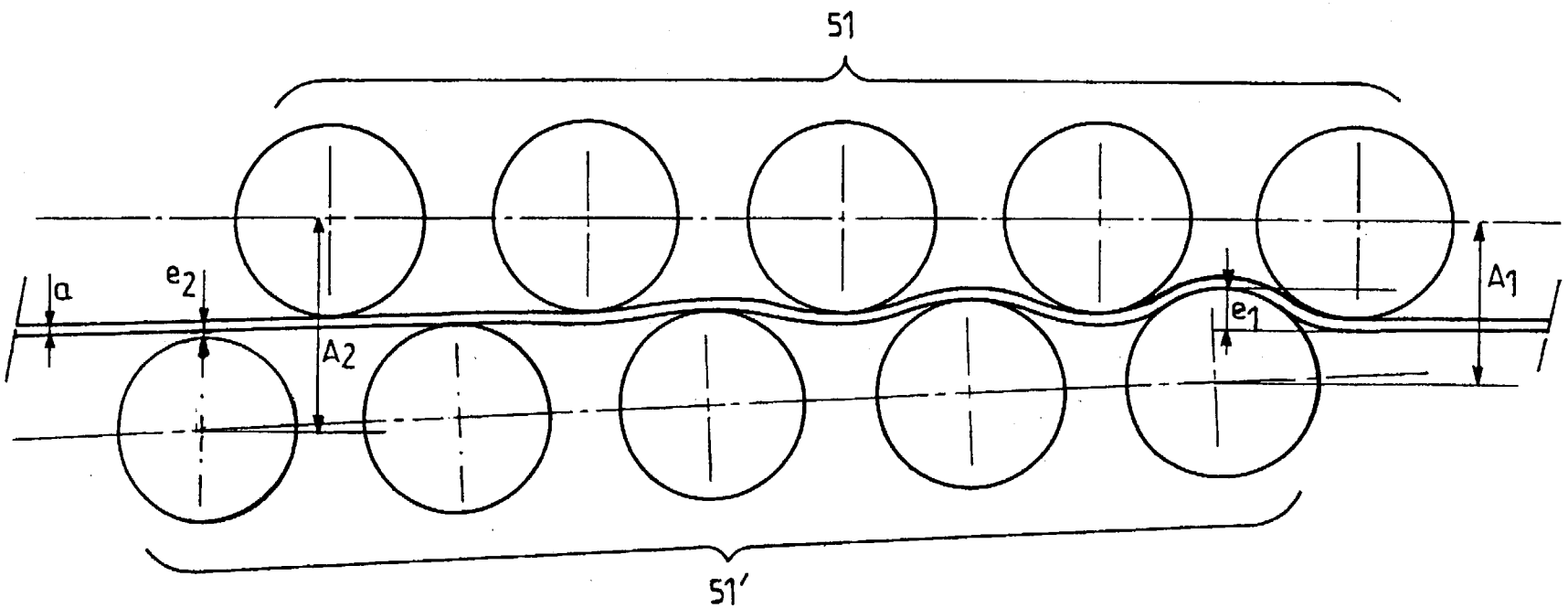
FIG. 3 is an schematic diagram, on an enlarged scale, showing the path taken by the strip through the multi-roller assembly.

It is thus possible, by acting separately or simultaneously on screw jacks 64 and 66, to adjust the imbrications of rollers at the input and output of multi-roller assembly 5 in order to set up a progressively degressive imbrication of the rollers in the strip feed direction, as shown in FIG. 3.

Of course, other equivalent means, for example hydraulic jacks or other actuators, can be used to modify the imbrications and relative orientations of the two roller assemblies.

In general, by acting in a concerted way on adjustment jacks 64 and 66, it is possible to adjust the center-to-center distances A1 at the input and A2 at the output of the planisher in order to modify the intensity and, possibly, the number of reversed bendings, in the manner; and shown in FIG. 3.

Figure 2:
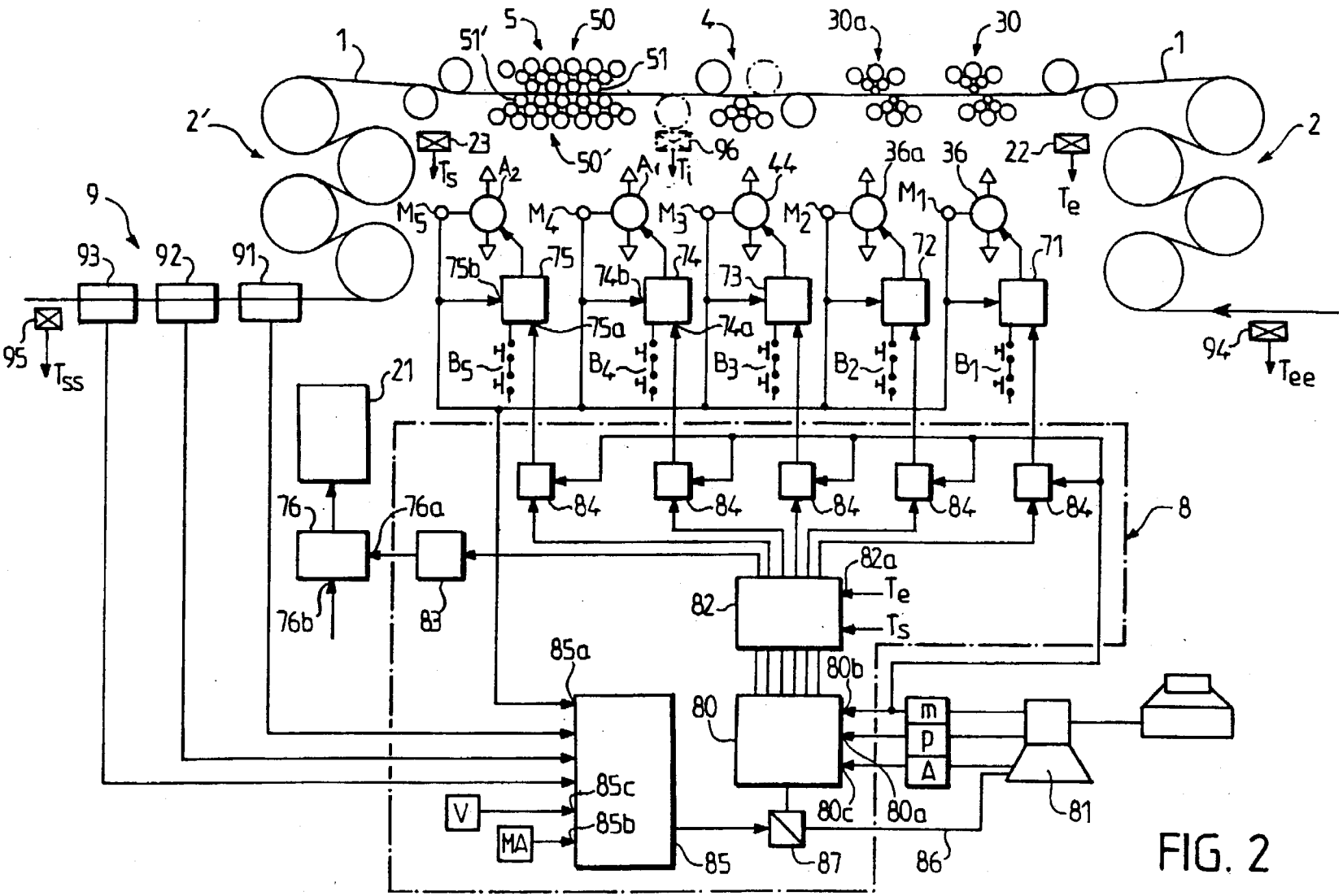
FIG. 2 is a functional diagram of the adjustment system of the overall installation.

For this purpose, the installation is advantageously associated with an adjustment system 7 shown schematically in FIG. 2, comprising positioning means 71 to 75 acting respectively:

- on jacks 36, 36*a*, to adjust the imbrications P1, P2, respectively, of the two bending units 30, 30*a*,
- on jack 44 to adjust the T effect of the anti-transversal camber device 4,
- on screw jacks 64 and 66, to adjust center-to-center spacings A1 at the input and A2 at the output of the multi-roller assembly 5.

Each positioning means 71 to 75, comprises a regulator receiving a positioning order furnished by a process control system 8 on a first input 71*a* to 75*a*, and, and on a second input 71*b* to 75*b*, a signal furnished by a measuring device M1 to M5 indicating the respective positions of the corresponding devices at all times, enabling the regulator to immediately command the correction needed in order to adapt the effect of the device in question to the command given at the same time by the automatic system 8.

Furthermore, after the operator has taken into account all the different types of data available to him, for example from observing the cut product, he can use push buttons B1 to B5, acting in opposite directions, to intervene on each positioning means 71 to 75 in order to make a correction, in one direction or the other, to the position of the respective device commanded by the automatic system 8.

Process control system 8 generates the position reference value of each positioning means 71 to 75 at each instant from a set of tables and/or a mathematical model 80 programmed so as to take account of the different characteristics of the installation and of the product to be planished and, in particular:

- the nature of the product, Quality code and Fault code,
- thickness and width,
- destination.

Indeed, it is possible to establish, in a known way, tables and equations that make it possible to define the actions to be exerted on the product by each of the elements of the apparatus, taking account of the mechanical characteristics, the known diameter of the rolls and rollers, their number and their imbrication, as well as the stresses applied to the product and interactions between the different devices.

These tables and equations are programmed in the mathematical modem 80 in which the operator can introduce, via an input 80*a*, all the product's specific parameters (p), notably those mentioned above, and via an input 80*b*the machine's specific parameters (m) such as the diameters of the rolls and rollers of each of the devices, which can be measured either permanently or checked during shutdowns. These parameters are introduced via console 81 by the operator each time a new coil or a series of coils of a certain type arrives.

On another input 80*c*of mathematical model 80, the elongation A is entered that must be imposed on the strip in order to correct the flatness fault detected on the upside of the installation, for example by a flatness measurement roller of a known type.

This imposed elongation is determined in the usual way by taking into account the characteristics of the product and of the machine and by remaining within predetermined tensile stress domains.

From all these parameters and programmed equations, mathematical model 80 generates, on the one hand, an elongation reference value and, on the other hand, imbrication reference values for the different devices.

The elongation reference value is entered at input 76*a* of a device 76 for adjusting drive mechanism 21 of tension blocks 2, 2', such a mechanism making it possible, in a known way, to maintain the difference in speed between the upside and downside blocks corresponding to the prescribed elongation.

However, elongation reference value A depends on the diameters of the rollers and can therefore the tension rollers and can therefore be corrected by a device 83 to take account of any possible changes of the diameters.

Tensions Te and Ts applied to the strip, respectively at the input and output of the installation, are a consequence of the process and do not normally intervene in the reference value determination system. Nevertheless, the tensions must of course be limited for safety reasons and must in any case always remain below the elastic limit of the product, preferably between approximately 20 and 60% of that limit, the strongest traction referring to the thinnest strips and with the strongest elastic limit.

For this purpose, the installation is equipped with devices 22, 23, for measuring the tensions Te at the input and Ts at the output, respectively, the measured tensions being entered at input 82*a* of a device 82 for correcting reference values. In the event predetermined values are exceeded, the process control system can then react either by generating a simple alarm or by direct action on all or some of the reference values it generates.

Imbrication reference values P1, P2 . . . P5 generated by mathematical model 80, and then corrected, are entered, respectively, on positioning means 71 to 75. As mentioned above, the mathematical model takes account of interactions between the different devices when generating imbrication reference values such that the prescribed elongation for the flatness correction is obtained almost entirely in planisher 3 by means of the two bending units 30, 30*a*, or possibly by only one of them, depending on the case.

However, the traction-bending effect applied to the product depends on the diameters of the rolls and rollers, and this is why, before being entered on each of the positioning means 71 to 75, the corresponding reference value is corrected in a device 84 associated with each positioning means in order to correct the reference value according to the real diameters of the rolls or rollers of the considered device, and which can be measured, for example, each time the machine is stopped.

Moreover, as mentioned above, the operator is also able to intervene on the adjustments of the machine's different devices by means of push buttons B1 to B5.

Of course, such corrections must only be made by a suitably qualified operator.

Thanks to these arrangements, the adjustment system is able to function fully automatically, yet also allows an operator to intervene and correct reference values in order to adjust imbrications.

Measuring devices M1 to M5 are associated with each device, each one supplying a signal representative of the actual position, at the considered time, of the rolls or rollers of the considered device. These signals are entered on input 85*a* of a self-adapting system 85 which, on the operator's command, can intervene in the process control system and automatically correct the imbrication reference values so that they correspond to the measured positions, the corrections made by the operator being maintained up to the end of the winding of the coil as well as for succeeding coils of the same type.

Furthermore, after validation on an input 85*c* of self-adapting system 85 by a competent authority, self-adapting system 85 can intervene on mathematical model 80 to correct certain values contained in the tables and readjust the mathematical model according to the adjustment values actually used.

Likewise, the actual elongation produced is measured and entered on input 85*b* of the self-adapting system which can then correct the elongation reference value previously entered on mathematical model 80 according to the effects noticed.

Self-adapting system 85 is a computer classification and management system which records all adjustments, classifies the results and allows the most appropriate values to be chosen for the strip currently being processed.

However, all these adjustments are simply kept in reserve in the self-adapting system which is locked by a device 87, the installation remaining driven by the mathematical model and offering the possibility of manual intervention by the operator.

If the operator deems the corrections as useful, he can unlock the self-adapting system from console 81 via a man-machine communication link 86 and introduce the corrected reference values into the process control system which will be used for the remainder of the winding of the coil and for following coils of the same type All the corrections made remain in the memory of the self-adapting system until they have been checked by a competent authority who, by means of a command 85*c*, can order the validation of certain corrections and the corresponding readjustment of mathematical model 80.

As a result, the mathematical model established from equations and theoretical considerations can be adapted to the measured or observed effects on the product.

Self-adapting system 85 makes it possible to almost immediately find the correct adjustments for new products from a mathematical model established for certain products, or else to adapt the system to new, more efficient reference values.

In practice, when a new coil is placed in position in the installation, the operator already knows a number of the product's specific parameters such as its different mechanical and dimensional characteristics, thickness, width, hardness, composition, etc. as well as its destination, and introduces these parameters via console 81 into mathematical model 80.

The operator may also know the flatness faults to be corrected, for example, if they are normally found on a given product type. He can also measure them by means of a device placed in position on the upside of the installation.

The operator determines the elongation to prescribed in planisher 3 to correct these faults from tables or a chart, or even according to reference values given by a computation system. This elongation is entered on input 80cof mathematical model 80 which, from programmed equations, determines the winding speeds of the tension blocks 2, 2', and the theoretical positions of planishing sets 30, 30*a* which will bring about the prescribed elongation during planishing. The mathematical model also calculates the effects of transversal and longitudinal cambering resulting, in theory, from actions carried out for planishing, and chooses a combination from the tensions and bendings in the planisher that will allow camber to be minimized. However, the residual effects are calculated and corrected in the multi-roller assembly 5 and, if necessary, the anti-transversal camber device 4, whose imbrications are determined by the mathematical model, taking account of all the interactions between the elements of the installation, and in such a way that the supplemental elongation produced in the multi-roller assembly does not exceed 0.2%, with practically no increase in tensile stress.

The result of the planishing can be verified by tests conducted on the strip leaving the installation and which is possibly split into narrow bands. Longitudinal or transversal camber measurements can, if necessary, be taken during the winding of the strip. Finally, the operator can also detect imperfections and residual faults on the strip by direct visual inspection.

The operator may also decide to correct certain imbrication values generated by the mathematical model and make his own corrections to certain computed imbrications by means of push buttons B1 to B5.

Since these corrections are made while the strip is winding, the operator acts, preferably, on the less sensitive actuators that provide much larger adjustment latitude. In particular, the operator can first of all vary imbrication A2 at the output of the multi-roller assembly to increase or reduce the number and intensity of degressive bendings and, if the need arises, to act on imbrication A1 at the input, this adjustment being more sensitive.

Thanks to the wide adjustment possibilities offered by the multi-roller assembly, this manual action by the operator is essential in order to remove longitudinal cambering.

However, the operator can also intervene on planishers 30, 30*a*, and, possibly, the anti-transversal camber device 4, by means of push buttons B1 to B3 in order to take account of interactions between the two parts of the installation, and finish planishing according to the actual characteristics and properties of the strip currently being wound through.

As mentioned above, the corrections made are recorded and optimized in self-adapting system 85.

If the competent authority decides, after verification, that the adjustments made are valid for all strips of the type currently being wound, for example for all strips of the same thickness and classified in the same category, these adjustments are validated by the input 85*c*, and after unlocking the self-adapting system 85, the corrections previously made and deemed optimal are introduced into the memory of the mathematical model such that from this point onwards, the corrected reference values are imposed on other strips of the same category.

Likewise, corrections can be made, after validation, to the values located in self-adapting system 85.

In a similar way, if a new coil is not of a conventional type, it is possible, according to certain parameters such as its dimensions and the nature and hardness of the metal, to choose one or more types of reference from the known types that most closely resemble the new coil and enter on the mathematical model either the parameters of a very similar type, or parameters obtained by interpolation or extrapolation.

Mathematical model 80 adjusts the tensions and imbrications according to the entered parameters, after which coil winding can be started.

During winding, the operator can determine, from measurements or observations and from personal experience, the corrections that need to be made to the imbrications determined by the mathematical model. If the result is satisfactory, these corrections are validated by the competent authority and stored in the memory of the mathematical model which thus constitutes a new model applicable from then on to all coils of the same type.

The invention is not limited to the embodiment described above by way of example.

For example, it has already been mentioned that the planisher could comprise a single planishing set 30. The second set can be placed on the machine and simply, removed from service when not required. However, for certain types of product, a machine with a single planishing set can be used.

Likewise, the multi-roller assembly can correct the transversal camber fault and, in certain cases, anti-transversal camber device 4 can be omitted.

It should be noted in this connection that the respective arrangements of planishing sets 30, 30*a* and of anti-transversal camber device 4 with respect to strip 1, as shown in FIGS. 1 and 2, correspond to the most common case, but could, if necessary, be inverted, with anti-transversal camber roll 41 being placed in position above strip 1.

Indeed, the arrangement of the different devices as well as the order and number of live rollers in the multi-roller assembly 5 will generally be determined according to the characteristics, particularly thickness and hardness, of the range of products normally processed in the installation.

In particular, upper roller row 51 generally has one roller less than lower row 51', as shown in FIGS. 1 and 2, and the first live roller, on which the strip is completely stretched, is often the second in the series, but this arrangement could be modified according to the deformations targeted. For example, both rows could have the same number of rollers, as in the case of FIG. 3, or the longest row could be the upper row.

Deflector roller 45 located immediately downstream of the anti-transversal camber device can also be interchangeable and/or smaller in diameter, and adjustable in height in order to make it more or less active than simple deflector.

It is also of course clear that the configuration shown can be modified by removing certain deflectors or, alternatively, adding more deflectors at other locations.

Moreover, the installation described is a particularly improved installation in which all the adjustments are generated from tables and a mathematical model. In certain simple cases, however, it may be possible to use only tables established for different types of product from operations carried out previously on the same machine for similar products.

If the necessary equipment is available, the installation could also be completed by an assembly 9 of measuring means placed in position on the downside of output tension block 2' and comprising, for example, a device 91 for measuring residual flatness faults, for example from tensile stresses, a device 92 for measuring transversal camber, for example by laser, and a device 93 for measuring the longitudinal cambering fault, the measurements taken being inputted on the self-adapting system 85 which determines any necessary correction reference values. For example, the flatness measurement taken at 91 can lead to a correction on the prescribed elongation. The detection of longitudinal or transversal camber faults can lead to a correction on the imbrications, in priority on imbrication A2 on the downside of multi-roller assembly 5 and, if the need arises, on imbrication A1 at the input or on the imbrication of the anti-transversal camber device 4 when this is used.

The tension of the strip can also be measured outside the installation by tensiometers 94, 95, placed respectively on the upside of input tension block 2 and on the downside of output tension block 2'. From these external tension measurements, the process control system 8 can modify the elongation reference values if the multiplier coefficients of the tension blocks become too large. Actions on the external tractions can also be taken in the system, according to production contingencies and capacities for regulating parameters outside the installation. Measurement of the intermediary tension, for example at 96, on the upside of multi-roller assembly 5, can if necessary be used to correct the imbrications of planishing sets 30, 30*a*.

What is claimed:

1. Installation for planishing under traction a thin metal strip by processing said strip along a feed direction, said installation including a fraction-flexion planisher comprising at least one bending unit with two planishing sets offset in height and a multi-roller leveling assembly comprising upper and lower sets of rollers, each supporting a row of rollers parallel and offset longitudinally and in height so as to determine, by imbrication of the rollers, an undulating path of the strip with reverse bend, means for adjusting the imbrication of the planishing sets, means for adjusting the relative heights of the two rows of rollers of the leveling assembly and two tension blocks placed in position respectively on the upside and on the downside of the installation on the path of the strip and associated with means for adjusting the through-speeds in said blocks so as to make it possible to apply tensile stress on the strip that can cause a prescribed elongation of said strip, wherein:

at least one of the two rows of rollers is supported by a crib mounted for swinging movement about a horizontal axis parallel to the axes of the rollers and associated with means for vertically displacing and swinging the crib in order to adjust the imbrications of the rollers of the two rows, by modifying the center-to-center distances at the input and at the output of the multi-roller assembly, said means for adjusting the imbrications, respectively, of the planishing sets and multi-roller assembly, are associated, respectively, with positioning means controlled by a process control system comprising means for determining imbrications to impose on the different devices, taking account of all the parameters specific to the product and to the installation, and means for positioning the different devices according to the imbrication reference values generated by said determination means; and wherein the process control system is associated with a mathematical model on which can be entered, via a console, the parameters specific to the machine and specific to the product to process as well as the prescribed elongation reference value, said mathematical model generating imbrication reference values for each of the positioning means, said positioning means each forming a regulation means on which is entered the real position of the considered device and which commands the imbrication adjustment means to adapt the measured position to the corresponding imbrication reference value.

2. The planishing installation of claim 1, wherein the means for adjusting the through-speeds of the tension blocks are associated with an adjustment device which determines the difference in speed between said tension blocks corresponding to an elongation reference value generated by the mathematical model, said reference value able to be corrected according to the known diameter of the rollers of the tension blocks.

3. The planishing installation of claim 1 comprising means for manually adjusting the imbrications of the different devices and a self-adapting system able to class and memorize the manually performed corrections, said self-adapting system being connected to the mathematical model via a link having a locking system and which can be unlocked via a man-machine link in order to introduce and, possibly after validation, store in the mathematical model the corrections corresponding to a type of product and optimized by the self-adapting system.

4. Process for planishing under traction a thin metal strip by passing said strip along a feed direction in an installation comprising:

a planisher having at least one bending unit (30) with an upper planishing set (31) and a lower planishing set (32) respectively placed above and below said strip, each planishing set having a live roll bearing against supporting rolls, a first adjusting device (36) for adjusting an imbrication of said live rolls by varying a level of at least one of said upper and lower planishing sets (31, 32), a multi-roller leveling assembly (5) comprising upper and lower chassis (6, 6') each supporting a row (51, 51') of parallel rollers offset longitudinally and in height in such a way as to form, by imbrication of said upper and lower rollers, an undulating feed path of the strip with reverse bends, a second adjusting device (64, 66) for globally adjusting a spacing between said roller rows (51, 51') and for modifying an inclination of at least one of said rows (51') for adjusting center-to-center distances between said rollers (51, 51') respectively (A1) at an input and (A2) at an output of said multi-roller assembly in order to modify the intensity and number of reverse bends on said upper and lower rollers (51, 51'), two tension blocks (2, 2') respectively positioned on an upside and downside of the installation on the feed path of the strip to apply tensile stress tending to cause elongation of the strip, said tension blocks each having several rollers and being associated with a drive mechanism (21) for driving said rollers in rotation, an adjusting device (76) for adjusting a winding speed on the downside tension block (2') higher than on the upside tension block (2), and to maintain between said winding speeds a differential determining a desired elongation of the strip, an adjustment system comprising positioning means acting respectively (71) on the first device (36) for adjusting the imbrication of the bending unit (30) and (74, 75) on the second device (64, 66) for adjusting the respective imbrications at the input and output of the multi-roller levelling assembly, each of said positioning means (71, 74, 75) comprising a regulator receiving a positioning order from a process control system (8) and a signal from a measuring device (M1, M4, M5) indicating the respective positions of the first and second adjusting devices (34, 64, 66) for commanding the correction needed in order to adapt the effect of the considered adjusting device (36, 64, 66) to the order simultaneously given by the process control system (8), said process control system (8) comprising a mathematical model (80) for generating position reference values of each of said positioning means (71, 74, 75), a correcting device (82) for correcting said reference values and a self adapting system (85), means (81) for introducing in said mathematical model a specific parameter of the product, a specific parameter of the machine and the elongation (A) that must be imposed on the strip to correct a flatness fault detected on the upside of the installation, said mathematical model (80) generating an elongation reference value, said process comprising the steps of:

(a) adjusting the differential between the winding speeds of the two tension blocks (2, 2') in order to achieve a desired total elongation;

(b) generating in said process control system (8) the imbrication reference values of said first and second adjusting devices, taking into account the interaction between said devices and according to dimensional and structural characteristics of the strip, in such a way as to produce in the planisher (30) the elongation prescribed for the flatness correction while maintaining the tensile stress applied to the strip at approximately 60% of the elastic limit of the metal;

(c) adjusting the imbrications (A1, A2) respectively at the input and at the output of the multi-roller assembly (5) to correct camber faults while limiting the increase in traction in such a way that the supplemental elongation occurring in the multi-roller assembly does not normally exceed 0.2%.

5. The planishing process of claim 4, comprising the step of correcting the transversal camber at the same time as the longitudinal camber correction in the multi-roller assembly.

6. The planishing process of claim 4, comprising the step of correcting the transversal camber, at least partially, in an anti-transversal camber device placed in position between the planisher and the multi-roller assembly to correct the transversal camber at least partially before the input to the multi-roller assembly.

7. The planishing process of any one of claims 4 to 6, including the steps of permanently adjusting the imbrications of the planisher and multi-roller assembly for each coil during the winding of the strip, said process control system taking into account the main dimensional, structural and qualitative characteristics of the product, the known diameters of the live rolls, the tension applied to the strip to obtain the prescribed elongation and the interactions between the different devices of the installation.

8. The planishing process of claim 7, comprising the steps of taking into account on said mathematical model, prior to processing of a coil, indications obtained by measurement or observation of residual flatness faults and longitudinal and transverse camber faults during the processing of a strip of similar nature and dimensions to the product to be processed.

9. The planishing process of any one of claims 4 to 6, comprising the step of manually correcting at any time each of the adjustments controlled by the process control system according to measurements or observations carried out on the product during and/or after processing.

10. The planishing process of claim 9, comprising the steps of recording, classing and optimizing the manual corrections thus made in a self-adapting system which stores them in memory, and, after unlocking by the operator, introducing necessary modifications into the process control system, and thus, from then onwards, imposing the imbrication reference values thus corrected on the different devices during the feeding of the strip and for the following strips of the same types when the same conditions are present.

11. The planishing process of claim 10, comprising the steps of validating, after checking, at least some of the corrections recorded in the self-adapting system and introducing the validated corrections into the mathematical model, which is readjusted so that the generated reference values correspond to the previously corrected imbrications.

12. The planishing process of claim 11, for processing a coil whose characteristics do not correspond to those of an already processed coil, said process comprising the steps of choosing one or more reference types corresponding as close as possible to the new coil, and the parameters corresponding to a type very close to it, entering interpolated or extrapolated parameters into the process control system, according to the type or types of reference, the tension and imbrication reference values of the different devices for the new coil, starting the winding of the coil, manually correcting the reference values determined by the process control system according to the effects obtained on the strip during winding, recording the corrections thus made in the self-adapting system, and introducing the recorded corrections into the process control system so as to correct the reference value generated for the remainder of the winding of the coil and for similar coils.

13. The planishing process of claim 12, comprising the steps of validating at least some of the corrections made manually and introducing the validated corrections into the mathematical model to readjust it and a new model adapted to all similar coils.

* * * * *